US011207565B2

(12) United States Patent
Venner

(10) Patent No.: US 11,207,565 B2
(45) Date of Patent: Dec. 28, 2021

(54) TRAINING DEVICE BALANCE BODY AND HOLDER MEANS

(71) Applicant: ULTIMATEINSTABILITY B.V., Amsterdam (NL)

(72) Inventor: Paul Venner, Amsterdam (NL)

(73) Assignee: ULTIMATEINSTABILITY B.V., Amsterdam (NL)

( * ) Notice: Subject to any disclaimer, the term of this patent is extended or adjusted under 35 U.S.C. 154(b) by 0 days.

(21) Appl. No.: 16/333,578

(22) PCT Filed: Aug. 17, 2017

(86) PCT No.: PCT/NL2017/050543
§ 371 (c)(1),
(2) Date: Mar. 14, 2019

(87) PCT Pub. No.: WO2018/052284
PCT Pub. Date: Mar. 22, 2018

(65) Prior Publication Data

US 2019/0255389 A1 Aug. 22, 2019

(30) Foreign Application Priority Data

Sep. 15, 2016 (NL) ..... 2017464

(51) Int. Cl.
*A63B 26/00* (2006.01)
*A63B 21/00* (2006.01)
(Continued)

(52) U.S. Cl.
CPC ..... *A63B 26/003* (2013.01); *A63B 21/00* (2013.01); *A63B 21/0004* (2013.01);
(Continued)

(58) Field of Classification Search
CPC ... A63B 21/06; A63B 21/00065; A63B 21/00; A63B 21/4007; A63B 21/0603;
(Continued)

(56) References Cited

U.S. PATENT DOCUMENTS 4,332,379 A 6/1982 Bannister
4,948,122 A 8/1990 Andrews, Sr.
(Continued)

FOREIGN PATENT DOCUMENTS

CA 2162296 A1 5/1997
ES 2371887 A1 1/2012
(Continued)

OTHER PUBLICATIONS

Ryan Delaney, "From Grocery Shelves To Pop Culture: A Century of Coca-Cola Bottles," Nov. 19, 2015, NPR, 5 pages, retrieved from the Internet: https://www.npr.org/2015/11/19/456628798/from-grocery-shelves-to-pop-culture-a-century-of-coca-cola-bottles (Year: 2015).*
(Continued)

*Primary Examiner* — Megan Anderson
*Assistant Examiner* — Kathleen Vermillera
(74) *Attorney, Agent, or Firm* — Perry + Currier Inc.

(57) ABSTRACT

A training device for the human or animal body includes a balance body with a movable centre of mass and a holder with which the balance body can be carried. The holder includes a harness with connectors for connecting to a torso of the body and with a cavity in which the balance body is at least partially received and fixed. The harness particularly includes a first part with connector for attaching to a back of the user and a second part connected releasably to the first part. The first part and the second part adjoin each other so
(Continued)

as to form a cavity which is open on both sides and in which the balance part is at least partially received in substantially fitting manner.

9 Claims, 3 Drawing Sheets

(51) Int. Cl.
*A63B 21/06* (2006.01)
*A63B 21/065* (2006.01)

(52) U.S. Cl.
CPC ..... *A63B 21/00065* (2013.01); *A63B 21/06* (2013.01); *A63B 21/0602* (2013.01); *A63B 21/0603* (2013.01); *A63B 21/065* (2013.01); *A63B 21/4005* (2015.10); *A63B 21/4007* (2015.10); *A63B 21/4009* (2015.10); *A63B 2208/14* (2013.01)

(58) Field of Classification Search
CPC ..... A63B 21/065; A63B 21/0602; A63B 21/0004; A63B 21/4009; A63B 21/4005; A63B 21/00061; A63B 21/00178; A63B 21/40; A63B 21/4001; A63B 21/4025; A63B 2208/14; A63B 26/003; A63B 2209/10; A63B 2209/00; A63B 2209/02; A63B 2225/62; A63B 2210/50; A45F 3/02; A45F 3/04; A45F 3/08; A45F 3/10; A45F 2003/025; A45F 2003/045; A45F 2003/003; A45F 4/02; A45F 2004/006
See application file for complete search history.

(56) References Cited

U.S. PATENT DOCUMENTS 5,167,600 A * 12/1992 Baird ..... A63B 21/065 482/100
5,299,999 A * 4/1994 Brine ..... A63B 21/065 221/210
5,921,435 A * 7/1999 Billet ..... A45F 3/04 221/185
6,216,926 B1 * 4/2001 Pratt ..... A45F 3/04 224/148.2
7,228,996 B2 * 6/2007 Keller ..... A47D 13/025 224/160
8,795,142 B2 * 8/2014 McClellan ..... A63B 21/00072 482/104
8,911,334 B1 12/2014 Cotter et al.
10,105,566 B2 * 10/2018 Buikema ..... A63B 21/075
10,517,375 B2 * 12/2019 Hoppa ..... A45F 3/04
2005/0096199 A1 5/2005 Egbert et al.
2006/0079383 A1 4/2006 Hermans
2010/0032464 A1 * 2/2010 Gleason, Jr. ..... A45F 3/08 224/631
2010/0056347 A1 3/2010 Summers
2011/0183819 A1 * 7/2011 Pharoe ..... A63B 21/0552 482/105
2013/0190144 A1 7/2013 Ross
2014/0349819 A1 11/2014 McClellan

FOREIGN PATENT DOCUMENTS

JP S55171055 U 12/1980
JP 2002126123 A 5/2002
WO WO-2004096377 A2 11/2004
WO WO-2013030592 A1 3/2013

OTHER PUBLICATIONS

Alles Over Sport, Sportinnovator idee ultimateinstability hydrovest (with machine generated English translation of description),YouTube, entire video, 0.49 sec, Feb. 9, 2016, URL: https://www.youtube.com/watch?v-Of25mFvOZyU.

* cited by examiner

TRAINING DEVICE BALANCE BODY AND HOLDER MEANS

FIELD OF THE INVENTION

The present invention relates to a training device for the human or animal body comprising an at least substantially form-retaining balance body with a movable centre of mass and with holder means with which the balance body can be carried.

Such a device is commercially available under the brand names Aquaball and Aquabag. The former is a substantially spherical product, while an Aquabag comprises a substantially cylindrical balance body. Aquabags are used by professional sportspeople to produce explosive performances, increase functional strength and optimize the ability to learn. Physiotherapists use Aquabags to increase variation and interference during the recovery process, whereby weak spots become apparent sooner and more readily. Aquaballs can be used as kettlebell, medicine ball, tornado ball or dumbbell and can be utilized to improve anything from balance to quick manoeuvrability and explosive power. Professional sportspeople use these in training in order to improve their sport-specific performance. Physiotherapists use them to enhance a more effective recovery.

The balance body is formed in both cases by an inflatable body of plastic partially filled with water. The balance body hereby has a movable centre of mass since the liquid content is free to move in the body. Both Aquabags and Aquaballs have holder means in the form of a set of handles with which the device can be picked up and carried. In order to be able to move effectively the body needs to have the correct stability at the desired moment. The comfort zone of the motor system can be extended by preparing the body for constant change in the surroundings and by creating a great variation and complexity of tasks. This increases the possibility of effective behaviour in a specific situation.

A device of the type described in the preamble provides for this purpose a superior aid because the centre of mass of the balance body will be in continuous motion during dynamic exercises of the user, and will thus provide for such a load which is changeable and complex for the body. Both products have in this respect more than proven themselves in practice as effective support in for instance sport training, physiotherapy treatments and rehabilitation programs.

Both the stated known devices nevertheless have a drawback in that the relatively heavy balance body has to be held at all times and thereby limits the user in his/her movement and freedom of action. The present invention has for its object, among others, to provide a training device with which this drawback is obviated to at least significant extent.

BRIEF SUMMARY OF THE INVENTION

In order to achieve the stated object a training device of the type described in the preamble has the feature according to the invention that the holder means comprise a harness with connecting means for connecting to a torso of the body and with a cavity in which the balance body is at least partially received and in which the balance body is fixed. The training device thus provides a harness which can be connected to the torso of the user so that the user then has his or her hands free and is no longer limited by the device in the range of exercises that can be performed. Furthermore, the balance body thus forms one whole with the body of the user, whereby greater stability is achieved, and exercises are repeatedly reproducible to greater extent.

The balance body can be embodied in diverse shapes and sizes, wherein a mass thereof can also vary. A choice will be geared to the user and/or the exercise to be performed therewith. In order to be able to exchange the balance body relatively easily and quickly a preferred embodiment of the training device according to the invention has the feature that the balance body is connected releasably to the harness in the cavity. The balance body is thus removable from the harness and the same harness can be used for a larger, smaller or differently shaped balance body which meets the needs of the user or the training to be followed.

A further preferred embodiment of the training device according to the invention has in this respect the feature that the harness comprises a first part with the attaching means for attaching to a back of the user and a second part connected releasably to the first part, and that the first part and the second part adjoin each other so as to form a cavity which is open on both sides and in which the balance part is at least partially received in substantially fitting manner. The harness thus substantially comprises two mutually separable parts between which the balance body is enclosed. In order to remove and optionally exchange the balance body it suffices to release the second part from the first part in order to thus gain access to the balance body.

A particular embodiment of the training device has the feature according to the invention that the second part comprises a form-retaining frame with a base part and a cup-forming top part which at least substantially fits onto a contour of the balance body, and that the frame with the base part protrudes into an insertion cavity extending from the first part of the harness and is removable therefrom. The harness imparts stiffness and stability here to the rigid frame, which particularly comprises a tubular frame. The other part of the harness, in particular the first part connected to the torso of the user, can be deformable so as to adapt optimally to the anatomy of the user. The cup of the frame is adapted at least to a certain extent here to the dimensions and shape of the balance body to be used and can if desired be replaced together therewith.

In order to protect the frame and for a more attractive appearance of the whole, a further particular embodiment of the training device according to the invention has the feature that the frame is provided at least on a side remote from the cavity with a frame cover. The cover can here comprise a hard shell, which is optionally covered with a soft sleeve, or can comprise a flexible sleeve. A further particular embodiment of the training device according to the invention has in this respect the feature that the frame cover comprises a shell part and/or a flexible sleeve cover and snaps over the frame while following a contour of the frame. The frame cover is preferably releasable from the frame so that it can if desired be separately cleaned or replaced.

A further preferred embodiment of the training device has the feature according to the invention that the frame cover is provided with fixation means for releasable fixation of the balance body in the cup of the top part of the frame. The balance body can thus be laid into the cup of the frame and fixed therein by means of the fixation means extending from the frame cover. The balance body and the second part of the harness with the frame and the frame cover thus form a separate assembly which can be unified with and connected to the first part of the harness to form an integral unit.

In order to train or rehabilitate a user particularly in the area of lateral stability, a further particular embodiment of the training device according to the invention has the feature that the balance body is substantially cylindrical and comprises a cylindrical axis, and that the balance body is connected to the harness in an orientation in which the cylindrical axis is directed transversely of a longitudinal axis of the harness and the balance body protrudes laterally outside the harness on either side. The elongate cylindrical shape of the balance body thus extends mainly laterally, and even outside the boundaries of the harness or body of the user. This imparts a relatively large lateral swing and deflection to the movable centre of mass of the balance body when the device is subjected to a lateral impulse during an exercise. As a result of the mass inertia of the content of the body a relatively large lag effect is obtained which then has to be accommodated by the user. The user does however always have his/her hands free and is otherwise not further obstructed in his/her freedom of movement.

With a view to compactness of the device when not in use or during transport, a further preferred embodiment of the training device according to the invention has the feature that the balance body comprises an inflated body partially fillable with a liquid, in particular water. The inflatable balance body comprises for instance a flexible jacket which is inflatable to a fixed shape under air pressure and can be partially filled with a liquid such as water. In empty, deflated state the balance body thus has only a small size and a low weight.

The invention also relates to a harness of the type as applied in the training device according to the invention comprising fixation means for connecting to a torso of the body and comprising a cavity for receiving and fixing a balance body. The invention furthermore relates to a balance body comprising a body fillable with a liquid and inflatable to a substantially fixed shape and provided with fixation means for releasable fixation in the cavity of the harness.

BRIEF DESCRIPTION OF THE SEVERAL VIEWS OF THE DRAWINGS

The invention will now be further elucidated hereinbelow on the basis of an exemplary embodiment and an accompanying drawing. In the drawing.

The figures are otherwise schematic and not all drawn to the same scale. Some dimensions in particular may be exaggerated to greater or lesser extent for the sake of clarity. Corresponding parts are generally designated in the figures with the same reference numerals.

DETAILED DESCRIPTION OF THE INVENTION

Figure 1:
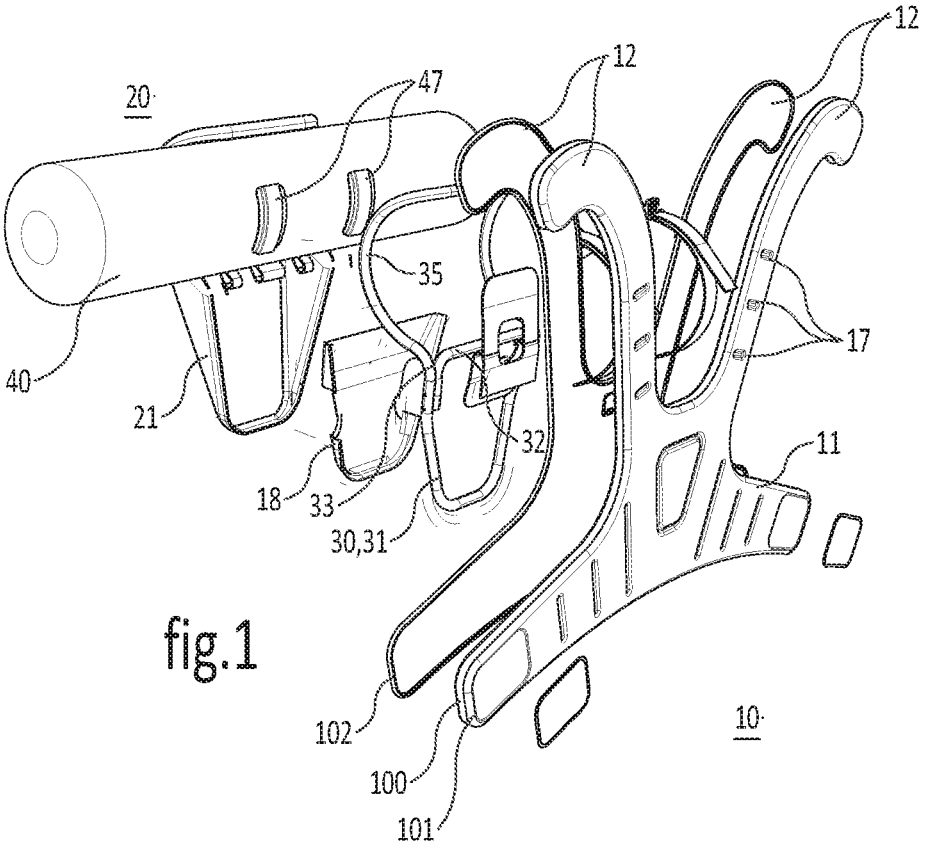
FIG. 1 is an exploded view of an exemplary embodiment of training device according to the invention.

FIG. 1 shows a cut-away exploded view of an example of a training device according to the invention. The device comprises a balance body 40 in the form of a cylindrical roll partially filled with a liquid. Such a balance body can be selected in various sizes and weights in accordance with the specific training purposes and the load the user can bear. It is thus possible for instance to opt for a small and medium-sized embodiment with a diameter of 20 centimetres and a length of respectively 65 and 85 centimetres. This produces a maximum load of respectively 15 kilograms and 25 kilograms. In addition, it is also possible to opt for a larger balance body with a diameter of 25 centimetres and a length of 85 centimetres, this producing a maximum load of 40 kilograms. This relates in all cases to a watertight inflatable body which, once empty, can be packed up in simple and compact manner, and thus requires little storage space. Via a closable filling opening (not shown) a quantity of water can be admitted therein as desired and, via a valve (likewise not shown), the balance body can then be inflated to the shown fixed shape with compressed air or inflated by mouth. An outer side of the balance body is formed by a smooth, readily washable and durable plastic coating.

Figure 3:
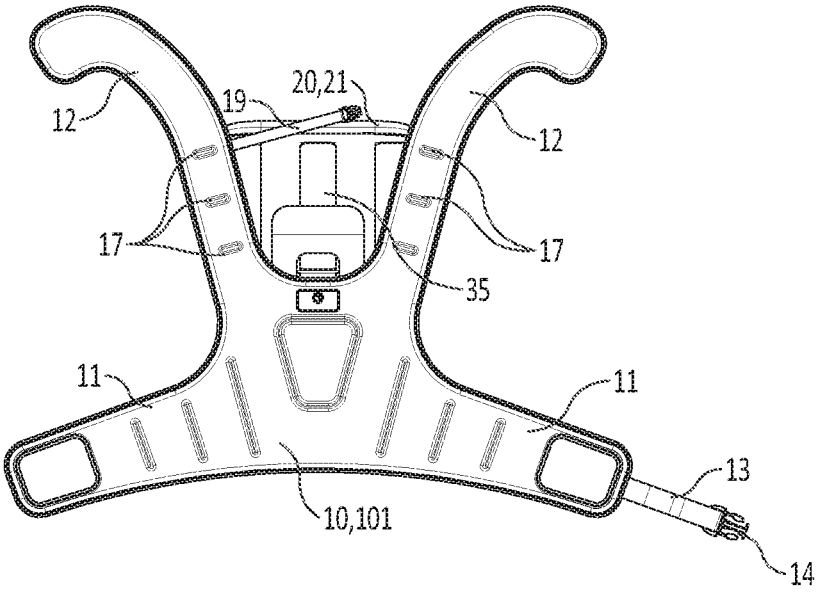
FIG. 3 is a front view of the device of FIG. 1.
Figure 4:
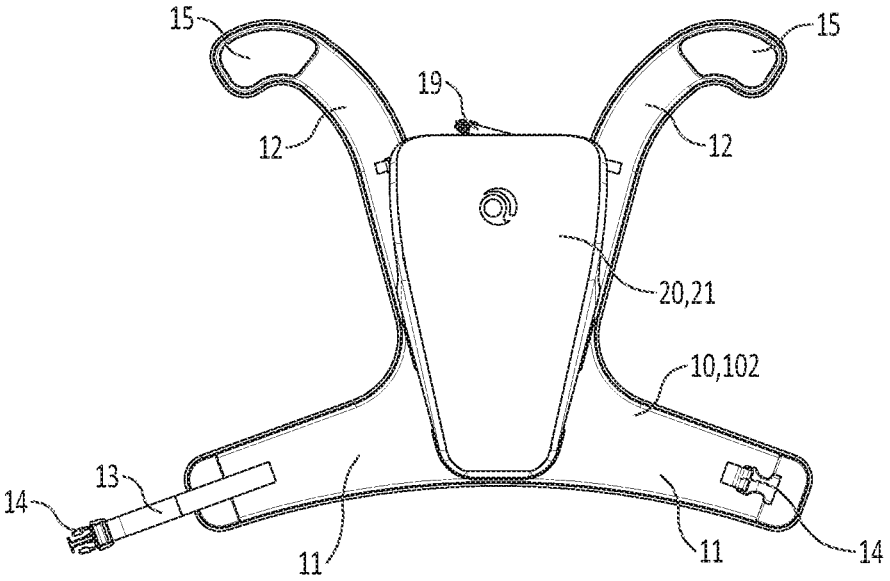
FIG. 4 is a rear view of the device of FIG. 1.
Figure 5:
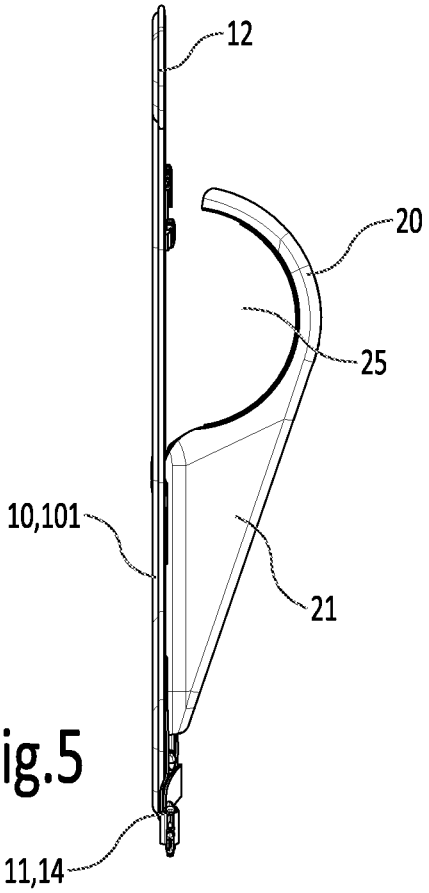
FIG. 5 is a side view of the device of FIG. 1.

For the purpose of a completely hands-free training the training device also comprises holder means with which balance body 40 can be carried. According to the invention the holder means extend from a harness 10,20 worn on the torso of the body of the user. Harness 10,20 has for this purpose connecting means in the form of a waist strap 11 and a set of shoulder straps 12 for connecting to the torso of the user which in this example extend from a first part of the harness, see also FIG. 3 and FIG. 4.

Harness 10,20 is worn on the back of the user and is highly adaptable to the body of the user. For the purpose of an effective distribution of power over the back of the user the first part of harness 10 comprises a core 100 formed from a suitable sheet material with a typical thickness in the order of 0.5-1.5 millimetres, in particular between 0.8 and 1.2 millimetres. Use is made herefor in this example of a plastic sheet, more specifically a sheet of polypropylene. This sheet is covered on a side facing toward the back of the user with comfortable foam zones 101 or a continuous foam layer which is typically half a centimetre to several centimetres thick. Use is preferably made herefor of a polymer foam with a closed cell structure for preventing penetration of (transpiration) moisture. A suitable foam material is for instance a polyurethane foam, and in particular a memory foam which is able to shape itself for a sustained period to the natural anatomy of the user. This foam layer 101 provides (wearer) comfort to the user and is moreover covered on the side facing toward the user with a 3-D mesh textile. By way of finish the core on the opposite visible side is glued or otherwise laminated with a robust cordura textile 102. A back panel, waist strap 11 and shoulder straps 12 of the harness are thus formed as one part from foam layer 101, core 100 and top layer 102.

The harness is further adaptable in that waist strap 11 comprises an adjustable closing strap with a quick release fastening 14 with which the waist strap can be adjusted to a waist of the user and secured. The shoulder straps are embodied with attaching pads 15, in this example Velcro® pads or hook and loop tape parts which correspond to similar attaching pads on waist strap 11 and which can be fixed thereon and adjusted, see also FIGS. 3 and 4. The device thus comprises a first part in the form of the harness which provides for a hands-free fixation to the body of the user.

Figure 2:
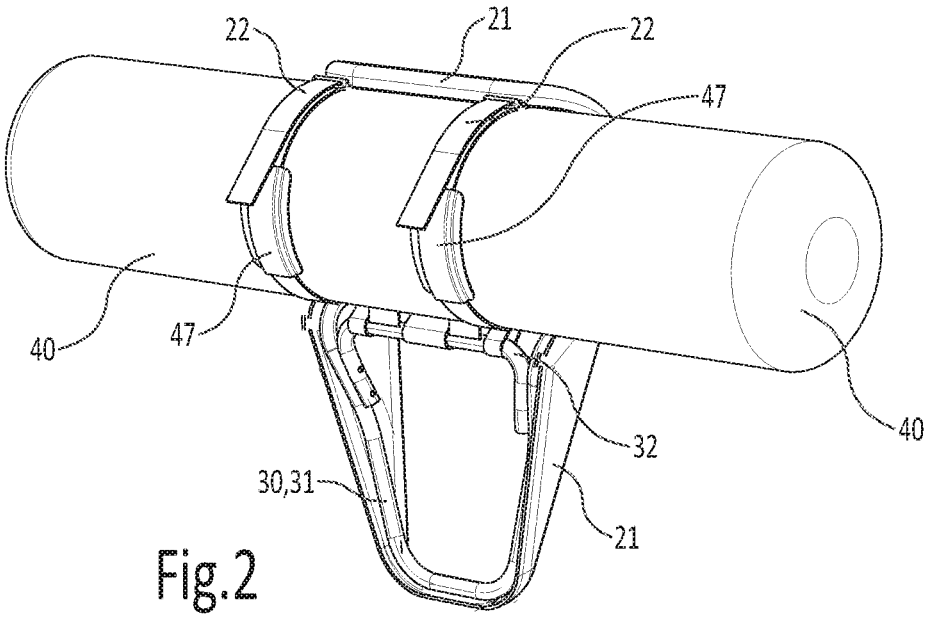
FIG. 2 is a perspective view of a balance part of the device of FIG. 1.

The device additionally comprises a second part 20 which is shown in further detail in perspective in FIG. 2 and which has the main purpose of holding the balance body 40. This second part of the harness comprises a frame 30 assembled from two form-retaining parts 31,32 connected rigidly to each other. For the constituent parts 31,32 of frame 30 use is made here of aluminium tube frame parts which are riveted or screwed to each other. Use can instead be made of plastic tubes, in particular parts of glass fibre or carbon fibre, and it is also possible to opt for parts with a solid core of a suitable composition or of a frame formed from one part.

Figure 6:
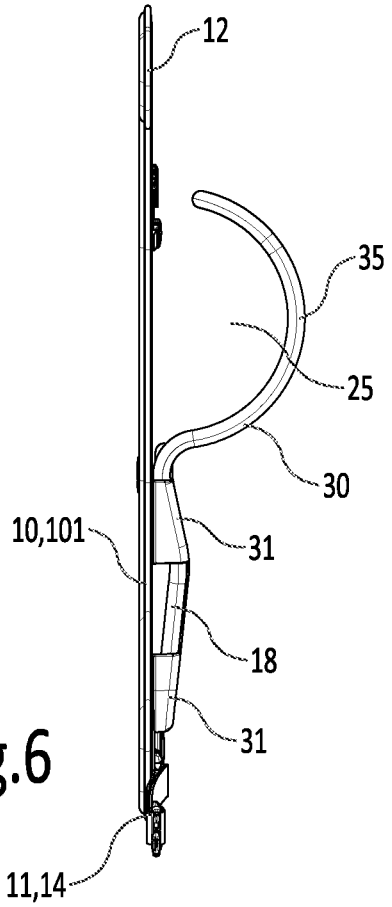
FIG. 6 shows the device of FIG. 1 in the side view of FIG. 5 without frame cover.
Figure 7:
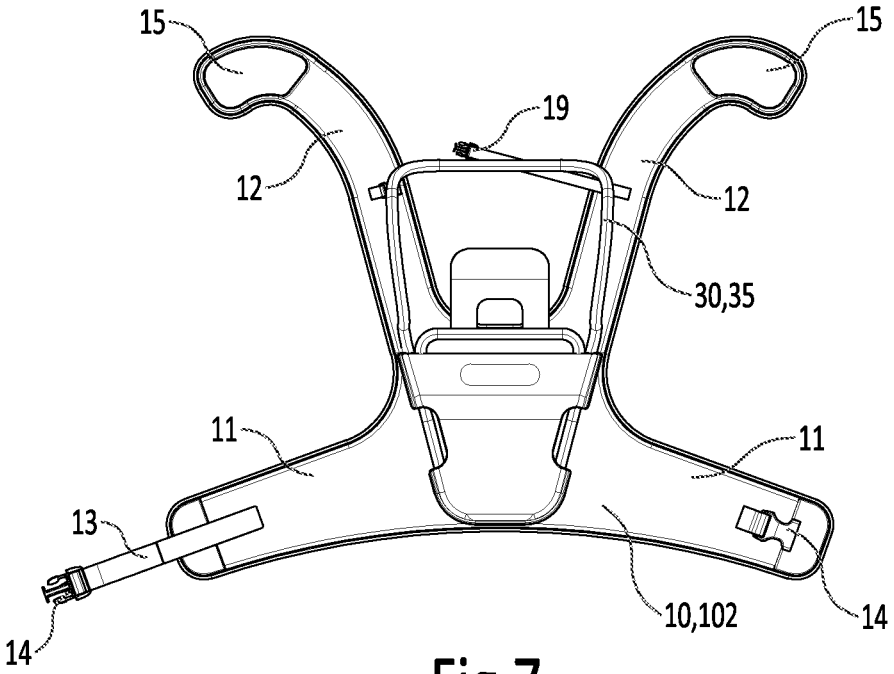
FIG. 7 shows the device of FIG. 1 in the rear view of FIG. 3 without frame cover.

The main purpose of frame 30 is to hold balance body 40 and impart stability and strength to the harness. For this purpose, the frame comprises on an upper side a top part 35 which forms a cup, see also FIG. 6, which at least substantially fits onto a contour of balance body 40. The inflated balance body 40 will moreover be able to conform to the shape of cavity 25 created by the cup of the frame. Frame 30 comprises at a base of cavity 25 a wedge 33 with which balance body 40 is supported. In addition, balance body 40 is fixed in cup 35 of the frame by a set of straps 22 extending from a cover 21 of the frame.

This frame cover 21 can form a form-retaining shell or jacket, as in this example, or a flexible sleeve, for instance of textile or plastic, and completely covers the frame on a side remote from the balance body. Straps 22 are adjustable and can be firmly tightened in order to fix the balance body sufficiently firmly in cup 35 of frame 30. Frame cover 21 is shaped and dimensioned such that it snaps without further attaching means over the frame and clamps fixedly thereon without extra fastening means being required for the purpose. In the case of a flexible sleeve use is advantageously made of an elastic contour strap so that the frame can be covered therewith in similar manner. Other or additional connecting means can however be provided if desired on the contact surfaces between the frame and the frame cover, such as for instance attaching strips in the form of hook and loop tape arranged on both the tubular frame and the frame cover. Such attaching strips or other disconnectable connecting means can advantageously also be provided on an inner side of the frame cover at the position of cavity 25 and correspond to complementary attaching strips or attaching means on an outer side of balance body 40.

Frame 30 also forms at a base thereof an insertion part which is received in an insertion cavity 18 extending from the first part of the harness. This provides the option of connecting second part 20 of the harness, with the balance body therein, releasably to first part 10, so enclosing the cavity with the balance body therein. The insertion cavity is formed here by a textile sleeve or pocket which is connected firmly to first part 10 of the harness and which is to some extent stretchable so that the insertion part of the frame is enclosed tightly therein. The stability of the thus formed harness assembly is further enhanced by a set of fastening strips 47 which extend from the balance body and which are received on corresponding attaching pads 17 on the harness. Use is advantageously also made for these fastening means of Velcro® or strips of hook and loop tape. In addition, the harness has a chest strap 19 which provides for a further fixation of the harness on the body so that both as it were form one whole.

Once assembled, the thus formed harness with balance body 40 therein can be worn on the back of the user and the user has his or her hands free, for instance for his or her regular (top-level) sport practice or rehabilitation training. Provided with the harness, the user will perceive the balance body as an integral extension of his/her own body. The device is used particularly here by professional sportspeople in order to produce explosive performances, increase functional strength and optimize the ability to learn. Physiotherapists can use the device to increase variation and interference during the recovery process, whereby weak spots become apparent sooner and more readily.

Although the invention has been further elucidated above on the basis of only a single exemplary embodiment, it will be apparent that the invention is by no means limited thereto. On the contrary, many variations and embodiments are still possible within the scope of the invention for a person with ordinary skill in the art.

The invention claimed is:

1. A training device for a user comprising a form-retaining balance body that is partly filled with a liquid to have a movable centre of mass that is changeable during an exercise and complex to handle for the muscular system of the user and a holder means configured to carry the form-retaining balance body, wherein the holder means comprises a harness having a connecting means configured to connect said harness to a torso of the user and having a cavity configured to accommodate at least part of said form-retaining balance body, wherein the form-retaining balance body is configured to be fixed in the cavity, wherein the centre of mass of the form-retaining balance body is configured to be in continuous motion during dynamic exercise of the user, wherein the form-retaining balance body is connected releasably to the harness in the cavity, wherein the harness comprises a first part configured to attach said harness to a back of the user and a second part connected releasably to the first part, and the first part and the second part adjoin each other so as to form said cavity, wherein said cavity is open on opposite sides and wherein the form-retaining balance body is at least partially received in the cavity in a fitting manner, wherein the second part comprises a form-retaining frame with a base part and a cup-forming top portion that fits onto a contour of the form-retaining balance body, and wherein said base part of the form-retaining frame protrudes into an insertion cavity that extends from the first part of the harness and is removable therefrom.

2. The training device as claimed in claim 1, wherein the form-retaining frame is provided with a frame cover.

3. The training device as claimed in claim 2, wherein the frame cover comprises a shell part or a flexible sleeve cover and snaps over the form-retaining frame while following a contour of the form-retaining frame.

4. The training device as claimed in claim 2, wherein the frame cover is provided with fixation means for releasable fixation of the form-retaining balance body in the cup-forming top portion of the form-retaining frame.

5. The training device as claimed in claim 1, wherein the form-retaining balance body comprises an inflated body partially filled with the liquid.

6. The training device as claimed in claim 5, wherein the liquid is water.

7. The training device as claimed in claim 1, wherein the harness further includes at least one strap and quick release fastening configured to attach said harness to the torso of the user and wherein the cavity is configured to receive and fix the form-retaining balance body that is at least partly filled with the liquid.

8. The training device as claimed in claim 7, wherein the form-retaining balance body further comprises a body that is at least partly finable with the liquid and inflatable to a fixed shape and the harness further comprises a cover of the form-retaining frame, wherein at least one strap extends from the cover of the form-retaining frame and is configured to releasably fix the form-retaining balance body in the cavity.

9. The training device as claimed in claim 1, wherein the form-retaining balance body is cylindrical, having a cylindrical axis, wherein the form-retaining balance body is configured to be connected to the harness in an orientation in which the cylindrical axis is directed transversely of a longitudinal axis of the harness and the form-retaining balance body protrudes laterally outside the harness.

* * * * *